US005948444A

United States Patent [19]

Naito et al.

[11] Patent Number: 5,948,444

[45] Date of Patent: Sep. 7, 1999

[54] INJECTION PLUG DEVICE FOR INJECTING CONCRETE REPAIRING AGENT INTO A CONCRETE STRUCTURE

[75] Inventors: Noboru Naito; Toyoki Sato, both of Yamagata-ken, Japan

[73] Assignees: Hayashi Kensetsu Kogyo Kabushiki Kaisha; Nihon Mente Kaihatsu Kabushiki Kaisha, both of Yamagata-ken, Japan

[21] Appl. No.: 08/933,407

[22] Filed: Sep. 19, 1997

[30] Foreign Application Priority Data

Sep. 19, 1996 [JP] Japan ..... 8-269369

[51] Int. Cl.[6] ..... E04G 23/02

[52] U.S. Cl. ..... 425/13; 425/11; 425/563; 425/567; 425/12

[58] Field of Search ..... 425/11, 12, 13, 425/563, 567; 52/742.14; 264/36

[56] References Cited

U.S. PATENT DOCUMENTS

| | | | |
|---|---|---|---|
| 5,186,949 | 2/1993 | Lai | 425/11 |
| 5,223,272 | 6/1993 | Pringle | 425/12 |
| 5,329,740 | 7/1994 | Hayashi et al. | 52/514 |
| 5,809,736 | 9/1998 | Naito et al. | 52/742.14 |

FOREIGN PATENT DOCUMENTS 5-239932 9/1993 Japan .

*Primary Examiner*—Harold Pyon
*Assistant Examiner*—Mark A. Wentink
*Attorney, Agent, or Firm*—Lyon & Lyon LLP

[57] ABSTRACT

An injection plug device for injecting concrete repairing agent into a concrete structure and a connector to be connected to such an injection plug device are provided. The injection plug device has a small diameter, a simple structure, and low manufacturing cost to be appropriate to be used as a disposable device. The injection plug device (10) for injecting concrete repairing agent into a concrete structure includes a tip side injection pipe (11); an end side injection pipe (12) for housing an end portion of the tip side injection pipe (11) at the tip portion thereof, an attaching device (13) comprising an elastic member**(13*a*) attached to the tip side injection pipe(11) to surround the outer surface thereof, and a compression device for compressing the elastic member(13*a*) in a direction parallel to an axis thereof to cause an expansion of the elastic member(13*a*) in its radial direction to make the elastic member attached to a inner wall of an injection hole; and a back flow preventing device (14)** formed inside of the end side injection pipe for preventing back flow of injected concrete repairing agent before its solidification.

5 Claims, 5 Drawing Sheets

INJECTION PLUG DEVICE FOR INJECTING CONCRETE REPAIRING AGENT INTO A CONCRETE STRUCTURE

BACKGROUND OF THE INVENTION

The present invention relates to an injection plug device for injecting concrete repairing agent into voids or cracks formed in a concrete structure and to a connector to be attached to such an injection plug device.

A typical concrete wall consists of an inner concrete body and an outer mortar layer measuring 2 cm–3 cm in thickness for covering and decorating the rough surface of the inner concrete body. Degradation caused by aging of the concrete may cause separation of the mortar layer from the surface of the concrete body, forming voids or cracks, sometimes called "floating areas," between the surface of concrete body and the mortar layer. These cracks are often 0.2 mm–1 mm wide.

As a typical method for repairing such a concrete wall with voids or cracks formed inside, the following repairing method is known. At first, an injection hole is formed in the wall so as to establish fluid communication between an area outside of the concrete wall and the voids inside. Then, an injection plug device will be inserted and fixed into the injection hole. Next, concrete repairing agent such as epoxy resin or polymer cement will be injected into the injection hole through the injection plug device to fill the voids. The repairing agent hardens or cures within the voids and provides a bond between the concrete body and mortar layer.

The injection plug devices described above are divided into two categories. One, a non-detachable type, is buried inside the repaired concrete wall. Bolt type devices which are hammered into the concrete wall are typical of these devices. The other is a detachable type, which may be detached and recovered from the repaired concrete wall. Detachable type injection plug devices are preferred non-detachable type injection plug devices often damage the finish and aesthetic appearance of the wall, because the top portion of the device usually protrudes from the surface of the repaired concrete wall.

The detachable type injection plug device described above preferably can be attached firmly to the concrete wall while concrete repairing agent is injected and before it is solidified, and can be detached easily from the concrete wall after the injected repairing agent is solidified. From this point of view, detached type injection plugs that are attached to the wall using adhesives are not preferred, because laborious and time consuming work is required to detach the devices from the concrete wall and to remove residual adhesives that makes spots on the wall to spoil a fine view of the wall.

An injection plug device which does not require such laborious work for removing residual adhesives from a concrete wall is disclosed by Japanese Utility Model Application S63-148748.

Further, detachable type injection plug devices often cannot be removed from a concrete wall until the injected concrete repairing agent is almost solidified so as to prevent back flow through the injection hole when the injection plug device is detached. As a result, laborious and time consuming work is often required to remove partially solidified repairing agent from inside of the plug device after the device has been detached from the concrete wall.

Furthermore, methods for preventing back flow of concrete repairing agent from the concrete wall during injection are divided into two categories. One category is characterized by the use of a check valve mechanism inside the plug device, and the other category is categorized by a check valve mechanism inside a hose, or connector which connects the hose to the injection plug device. It is preferable to set up a check valve mechanism inside the plug device, as this reduces the time required to complete an entire repairing operation in which a plurality of injection holes are formed on a concrete wall. This is so because it reduces the number of hoses and connectors that are required to complete the operation.

To eliminate the laborious work of removing partially solidified repairing agent from inside the injection plug device, it may be possible to make the plug device disposable by providing it with a simple and inexpensive structure. However, where it is desirable to use a detachable injection plug device which includes a back flow prevention mechanism, it is difficult to achieve an inexpensive design structure. Therefore, as is disclosed in a prior Japanese Patent Application (H4-75,176), an injection plug device of simple and inexpensive design was invented by the present inventors which has a coaxial double structure comprising an outer pipe member, and an inner disposable pipe member which is attached and detached easily to and from the outer pipe member.

The injection plug device according to the Japanese Patent Application described above has a substantial advantage in that it is not expensive and can be used very easily to reduce the time required for repairing operations. This is so because only the inner pipe member is made disposable. However, this injection plug device has relatively large outer diameter, about 20 mm, because it has a coaxial double structure. This requires an increase in diameter of the injection hole to be formed in a concrete wall. Further, such a injection hole must be treated so as not to spoil the appearance of the repaired concrete wall. However, the increase of diameter of the injection hole makes it difficult for the injection hole to be treated sufficiently to avoid damaging the finish of the concrete wall.

A connector for detachably connecting a tip portion of an injection hose to the injection plug device was invented by the present inventors and was disclosed in Japanese Patent Application H7-106,979 (U.S. patent application Ser. No. 08/628,856). This connector has a relatively complicated structure in which a path bending at a right angle is formed inside a plastic block to make injected concrete repairing agent flow through it. A needle valve is provided at the bend of the path to open and close the path. Since the structure of the connector of the prior art is relatively complicated, it has a problem in that it becomes difficult to remove partially solidified repairing agent from inside of the connector.

SUMMARY OF THE INVENTION

Accordingly, it is an object of the present invention to provide an injection plug device for injecting concrete repairing agent therethrough wherein the device has a small outer diameter to reduce the diameter of an injection hole to be formed in a concrete wall.

It is also an object of the present invention to provide an injection plug device of a simple structure that is inexpensive and is suitable for use as disposable device.

It is also an object of the present invention to provide a connector suitable for connecting an injection apparatus to the injection plug device.

These and other objects of the present invention will be attained by providing an injection plug device for injecting concrete repairing agent into a concrete structure. The injection plug device includes a tip side injection pipe, an end side injection pipe for housing an end portion of the tip side injection pipe, an attaching means consisting of an elastic member attached to the tip side injection pipe to surround the outer surface thereof, a compression means for compressing the elastic member in a direction parallel to an axis thereof to cause a radial expansion of the elastic member and to attach elastic member to an inner wall of an injection hole, and a back flow prevention means formed inside of the end side injection pipe for preventing back flow of injected concrete repairing agent before the repairing agent solidifies.

In an alternative embodiment, an injection plug device is provided which includes a tip portion capable of being attached in an injection hole formed in a concrete structure; a connector including a housing means having an end side housing portion for housing an end side portion of the injection plug device and a tip side housing portion of larger diameter than that of the end side housing portion, the tip side housing portion having a thread on the inner surface thereof; a ring member having a thread on the outer surface thereof for engaging the tip side housing portion of the housing means; and a ring shape packing means held between the tip side housing portion of the housing means and the ring member.

DETAILED EMBODIMENT OF THE PREFERRED EMBODIMENT

Figure 1A:
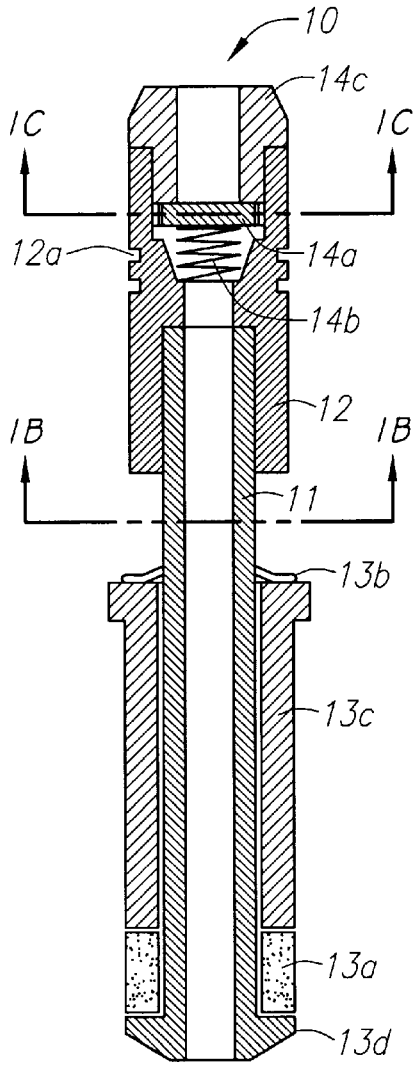
FIGS. 1(*a*)–(*c*) comprise sectional views (A), (B) and (C) showing a first embodiment of an injection plug device in accordance with the present invention.

FIGS. 1(*a*)–(*c*) comprise three sectional views showing a structure of concrete repairing agent injection plug device 10 according to an embodiment of the present invention. In the figure, (A) is a sectional view taken along a center line in an axial direction, (B) and (C) are sectional views taken along the lines X—X and Y—Y, respectively, in view (A).

Referring to sectional view (A), the injection plug device 10 comprises a tip side injection pipe 11, an end side injection pipe 12 to be attached to an end portion of the tip side injection pipe 11, an attaching mechanism 13 attached to an outer surface of the tip side injection pipe 11 and a back flow prevention mechanism 14 formed inside the end side injection pipe 12.

Both the tip side injection pipe 11 and the end side injection pipe 12 are made from resin (polypropylene). Each of the pipes 11 and 12 has a path of the same diameter formed therein. The paths of the pipes 11 and 12 are in fluid communication to allow concrete repairing agent flow through them. One end of the end side injection pipe 12 has a cavity formed therein that is adapted to slidably engage an end of the tip side pipe 11. Both of the injection pipes 11 and 12 may be connected more strongly by using adhesives, if necessary.

The attaching mechanism 13 formed on the outer surface of the tip side injection pipe 11 comprises a packing 13*a*, a stopper ring 13*b*, a sleeve 13*c* and a protrusion 13*d* formed on the tip portion of the tip side injection pipe 11. Prior to establishment of the tight connection between the pipes 11 and 12, the packing 13*a*, the sleeve 13*c* and the stopper ring 13*b* are arranged one by one on the outer surface of the pipe 11.

The packing 13*a* is made from elastic material of appropriate elasticity such as rubber to be loosely engaged by the outer surface of the tip side injection pipe 11 to prevent movement towards a tip portion of the pipe 11 by the flange like protrusion 13*d*. A pressure is applied to an end portion of the packing 13*a* by the stopper ring 13*b* through the sleeve 13*c*, which is slidably coupled to the outer surface of the injection pipe 11.

Figure 1B:
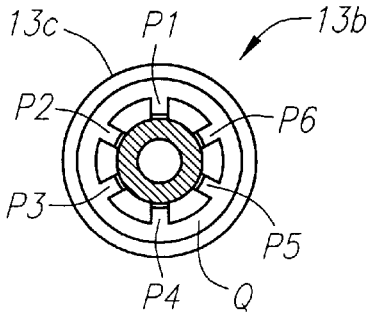

The stopper ring 13*b* is made from hard and strong steel. Referring to FIG. 1(B), the ring 13*b* comprises a peripheral ring portion Q and six tooth like protrusions P1–P6. Each protrusion protrudes radially toward a center of the ring portion Q, and each of the six portions of the ring portion Q are spaced an equal distance (angle of 60 degrees) from each other. Referring to FIG. 1(A), each of the protrusions P1–P6 is bent backward (towards an end portion of the injection pipe 11).

As a result, the stopper ring 13*b* can move forward (towards tip portion of the injection pipe 11) easily, but cannot move backward (towards end portion of the injection pipe 11) easily, because tips of the protrusion P1–P6 will go into outer surface of the injection pipe 11 when the stopper ring 13b moves backwards. Such a stopper ring is implemented by a stopper ring sold by Ochiai Seisakusho Co. under a product code CSTW-6.

To fix the injection plug device 10 inside an injection hole which is formed in a concrete wall, the stopper ring 13*b* is forced to move forward by using an appropriate tool to cause packing 13*a* to be shrunk in an axial direction through the sleeve 13*c*. As a result, the packing 13*b* will expand in radial direction causing its outer surface to be pressed strongly towards the inner surface of the injection hole. The injection plug device 10 is fixed strongly inside the injection hole by frictional force.

The back flow preventing mechanism 14 is formed inside the end side injection pipe 12. It comprises a plane sheet 14*a* which is made from material that has an appropriate elasticity and corrosion resistance (against the concrete repairing agent) such as rubber; a spring or coil 14*b* made from metal such as steel; and a bushing 14*c* made from resin such as poly propylene.

The bushing 14*c* has a generally cylindrical shape and a cavity formed therein for allowing injected concrete repairing agent flow through it. The diameter of an outer surface of the bushing 14*c* is decreased abruptly at the middle portion thereof to allow a tip portion thereof to be inserted tightly into an end portion of the injection pipe 12 to cause it to be attached strongly to the injection pipe 12. A tip of the bushing 14*c* forms a sharp knife edge to form a thin circular contact line on the sheet 14*a* to prevent the sheet 14*a* from being driven upward by an expansion force of the coil 14*b*.

Figure 1C:
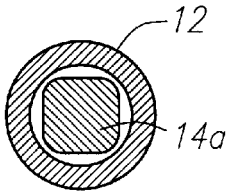

Referring to FIG. 1(C), the sheet 14*a* has a nearly square shape and size causing the four corners thereof to almost contact the inner wall of the injection pipe 12 to make four arcuate spaces between the four sides thereof and the circular inner wall of the injection pipe 12. Each of the four corners of the sheet 14*a* is cut off to allow it to move upward and downward smoothly.

Figure 2:
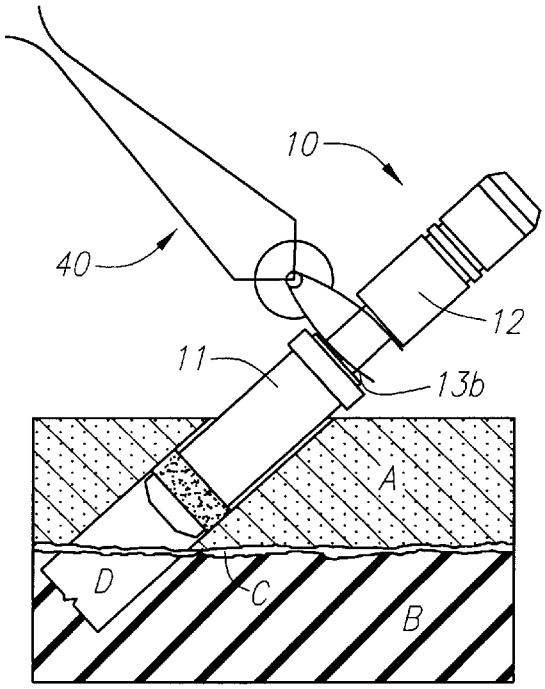
FIG. 2 is a partial sectional view showing a situation in which the injection plug device 10 of FIG. 1 is attached to an injection hole D formed in a concrete structure.

FIG. 2 is a partial sectional view showing a situation in which the injection plug device 10 in FIG. 1 is attached to a injection hole D formed in a concrete structure. The concrete structure to be repaired consists of an inner concrete body B and an outer mortar layer A for covering and decorating the rough surface of the inner concrete body B. A void C called a "floating area" is formed between body B and mortar layer A by degradation caused by aging of the concrete.

A circular injection hole D is formed so as to communicate with the void C by using a drill. The injection hole D is preferably formed at an angle with respect to the concrete wall so as to mitigate or eliminate the following problem. If the injection hole D is formed at an angle perpendicular to the wall, a collapse of the mortar layer A may occur just before the tip of the drill reaches the void C, because the thin mortar layer cannot resist the pressure produced by the tip of the drill. In such a case, a channel between the injection hole D and the void C may be closed by one or more fragments of the collapsed mortar layer C, causing injection of the repairing agent through the injection hole D to be difficult. Japanese patent application H4-75,176 may be referred to, if more detail about this phenomenon is required.

The diameter of the injection hole D to be formed in the concrete wall is made slightly larger than the outer diameter of the injection plug device 10 shown in FIG. 1. The tip side injection pipe 11 and attaching mechanism 13 formed on the outer surface of the injection pipe 11 of the plug device 10 are inserted into the injection hole D. Then, the stopper ring 13*b* is forced to move forward, e.g. towards to a tip portion of the injection plug device-10, by using a tool 40 like flat pliers.

As the stopper ring move forward, the packing 13*a* is made to shrink in an axial direction through the sleeve 13*c*. As a result, the packing 13*b* will expand in radial direction causing its outer surface to be pressed strongly towards the inner surface of the injection hole D. Thus, the injection plug may be fixed strongly inside the injection hole D by frictional force. As was described before, the stopper ring 13*b* cannot move backward easily, because tips of the protrusions P1–P6 will go into the outer surface of the injection pipe 11 when the stopper ring 13*b* moves backwards. Therefore, the attachment of the injection plug device 10 to the injection hole D is maintained.

Figure 3:
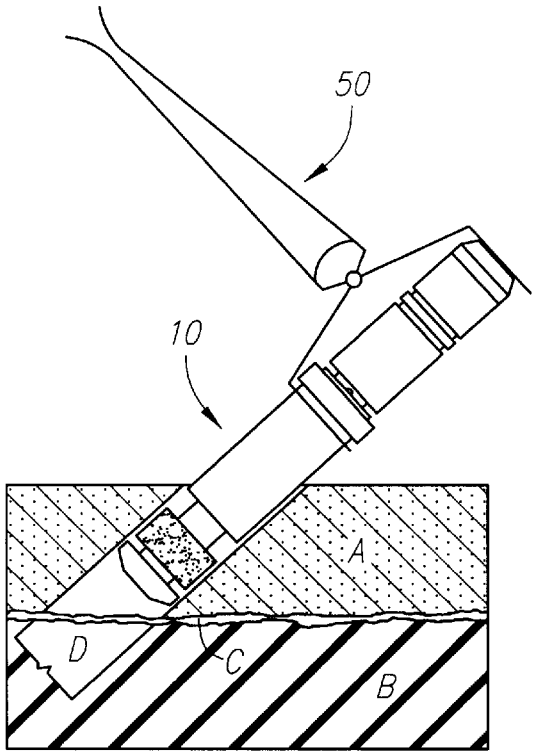
FIG. 3 is a partial sectional view showing a situation in which the injection plug device 10 in FIG. 1 is detached from an injection hole D after concrete repairing agent has been injected into the hole D and solidified.

FIG. 3 is a partial sectional view showing the plug device 10 being detached from the injection hole D after injected concrete repairing agent has been injected into the wall and allowed to solidify. The stopper ring 13*b* is driven backward toward the end portion of the device 10 by using a tool 50 like a flat pliers. Parts of the stopper ring 13*b*, such as the tooth like protrusions, may be broken, because a fairly strong force is required to drive the stopper ring backward. However, this does not cause a substantial problem, even if the stopper ring 13*b* is broken, because the injection plug device 10 including the stopper ring 13*b* is assumed to be disposable.

As the stopper ring 13*b* is driven backward, the packing 13*a* will be expanded along its axial direction causing shrinkage of the packing 13*a* in its radial direction and causing the frictional force between the plug device 10 and the injection hole D to disappear. This renders the plug device 10 detachable from the injection hole D. The detached injection plug device 10 will be thrown away to save time and laborious work to remove almost solidified concrete repairing agent from inside.

Figure 4:
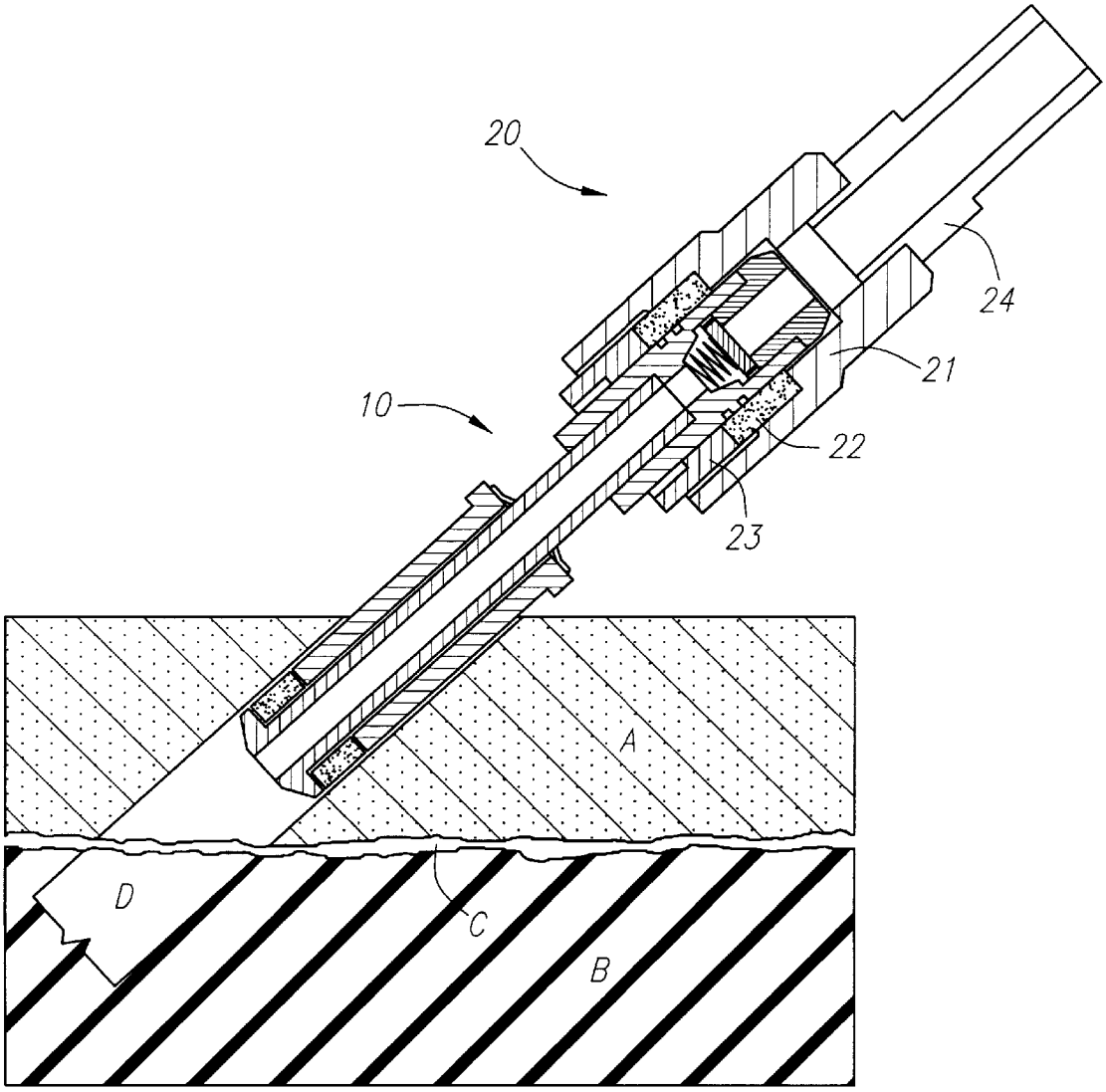
FIG. 4 is a sectional view showing the injection plug device shown in FIG. 1 and a connector in accordance with an embodiment of the present invention.

In FIG. 4, a connector 20 is shown attached to the injection plug device 10 as was shown in FIG. 1. The connector 20 comprises a housing 21, a packing 22, a screw plug 23 and a hose connector 24 to which a tip of a hose extended from an electric power pump or manual pump is connected.

Inside the housing 21 of the connector 20, an end side housing portion for housing the bushing 14*c* of the injection plug device 10 and tip side housing portion having an inner wall of increased diameter are provided. A thread is formed on the inner wall of the end side housing portion of the housing 21 to which a tip portion of hose connector 24 is engaged. The packing 22 having a shape like a ring is accepted in the tip side housing portion of the housing 20, and the screw plug 23 is engaged to the thread formed on the inner wall of the tip side housing portion.

In the embodiment, packing 22 is preferably made from urethane rubber taking into account its elasticity and anti abrasion, and its inner diameter is made almost equal to the outer diameter of the injection pipe 12. The packing 22 is made to press strongly against the outer surface of the injection pipe 12, by making the screw plug 23 move toward the end portion of the injection plug device 10. This causes the packing 22 to shrink in an axial direction and expand in a radial direction. As a result, a mechanical connection and liquid sealing are made between the connector 20 and the injection plug device 10 through packing 22. Two grooves 12*a* are made on the outer surface of the injection pipe 12 to enhance the effect of the mechanical connection and liquid sealing as shown in FIG. 1(A).

Concrete repairing agent is forcibly injected into the injection plug device 10 through the connector 20, passes through the bushing 14*c*, and makes the sheet 14*a* move downward against expansion force of the coil 14*b*. This allows the repairing agent to flow inside the tip side injection pipe 11 through arcuate spaces formed between the sheet 14*a* and the inner surface of the injection pipe 12. The concrete repairing agent forced into the injection pipe 11 flows finally into the void C through the injection hole D.

In a case in which a concrete wall has wide area to be repaired, a plurality of injection holes will be formed on the wall, and the injection plug device shown in FIG. 1 will be attached in each of the injection holes. An injection pump for injecting concrete repairing agent into the wall will be connected to each of the injection plug devices through a hose and a connector. In a typical case in which only one pump is used, injection operation will be repeated successively to each of the injection plug devices one by one according to their position on the wall, with the lowest plugs being used the first.

In this case, air in the voids or cracks inside the concrete wall should be purged outside the wall to make injection of repairing agent possible. However, the purge of the air inside the wall will be prevented by the back flow prevention mechanism 14 of the injection plug devices of the upper positions to which a pump has not yet been connected. Therefore, an air purge plug 30 as shown in FIG. 5 will be inserted into the bushing 14*c* to disable the function of the back flow mechanism 14 of the plug devices to which the injections have not yet been done.

When a sufficient amount of concrete repairing agent has been injected from a pump into the void through the injection plug device, excess repairing agent will begin to flow back outside the wall through an injection plug device just above the one connected to the pump. This is because the plug devices just above the back flow prevention mechanism are disabled by the air purge plug 30. The flow back of the repairing agent informs operator the end of injection through the plug device. Thus, by using the air purge plug 30, both purging air outside the concrete wall and acknowledging the end of the injection through the current injection plug device can be achieved.

Figure 5:
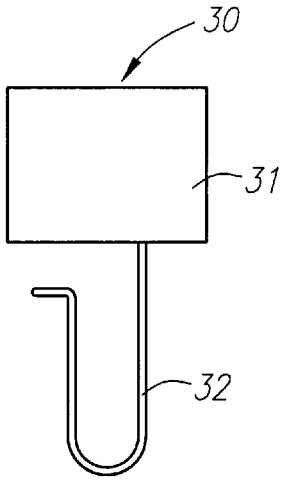
FIG. 5 is a front view showing an embodiment of an air purge plug as an accessory of the injection plug device.
Figure 6:
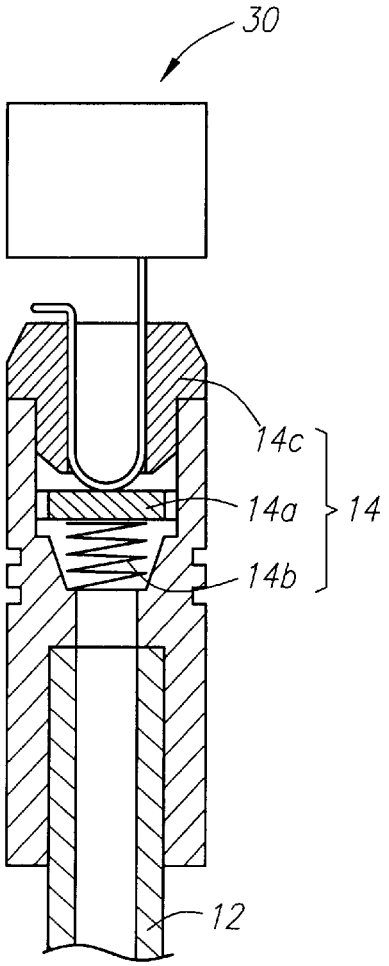
FIG. 6 is a partial sectional view showing an air purge plug together with a back flow prevention mechanism of an injection plug device in accordance with the present invention.
Figure 7A:
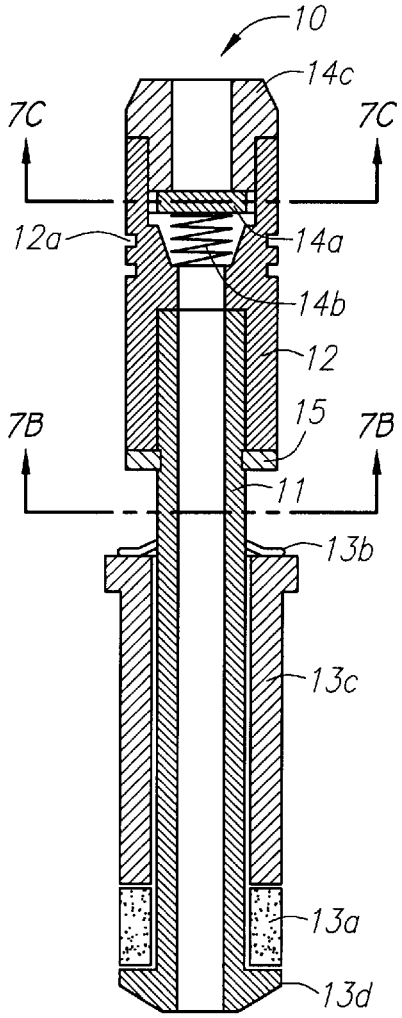
FIGS. 7(*a*)–(*c*) provide views of another embodiment of an injection plug device in accordance with the present invention.
Figure 7B:
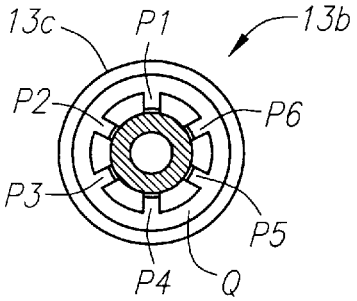
Figure 7C:
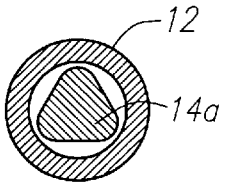
Figure 7A:
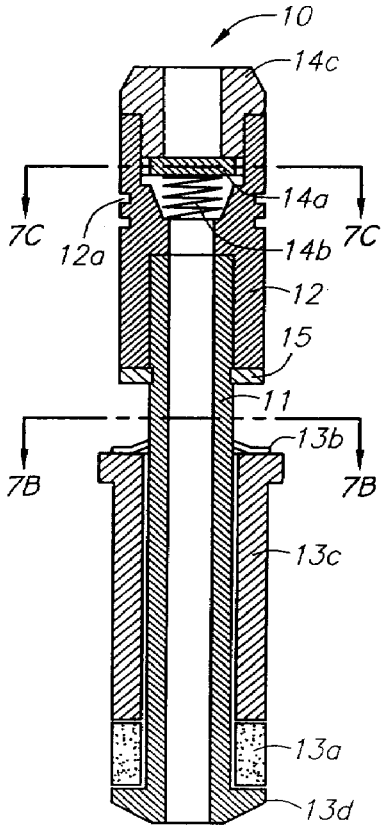
Figure 7B:
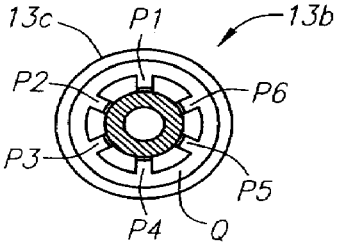
Figure 7C:
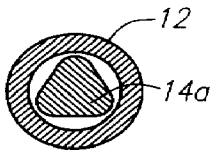

FIG. 5 is a front view showing the air purge plug 30 which comprises a column top 31 made from appropriate resin and a U-shape clip 32 made from steel wire protruding downward from the bottom of the top 31. As shown in FIG. 6, by inserting the U-shape clip 32 of the air purge plug 30 inside the bushing 14*c* to press down the sheet 14*a* of the back flow preventing mechanism 14, a void inside the concrete wall can be vented to the air outside the wall through the injection plug device.

In FIGS. 7(*a*)–(*c*), another embodiment of the injection plug device of the present invention is shown. In this embodiment, an iron ring 15 is added to be attached tightly to the outer surface of the tip side injection pipe 11. The iron ring 15 is tightly secured to the tip side injection pipe 11 through the use of a caulker device. The iron ring 15 is useful to prevent the end side injection pipe 12 from being disconnected from the tip side injection pipe 11 when the stopper ring 13*b* is forced to move forward using a tool 40 as shown in FIG. 2. The reason for this is that a strong force which is otherwise applied to the tip portion of the injection pipe 12 is applied to the iron ring 15 which is tightly attached to the outer surface of the tip side injection pipe 11.

In the embodiment shown in FIG. 7(*c*), the sheet 14*a* of the back flow prevention mechanism 14 has a triangular shape making a wider path for concrete repairing agent to be injected though the mechanism in comparison to the embodiment shown in FIG. 1(*c*).

As has been described in detail, the injection plug device for the concrete repairing agent of the present invention makes it possible to make a size of the injection hole smaller and to minimize damage to the appearance of a concrete wall after reparations have been completed. This is done by forming the tip side portion of the tip side injection pipe of small diameter, providing the attaching mechanism outside and inserting the tip side injection pipe into injection hole, and by forming the end side portion by the end side injection pipe of large diameter such that the back flow prevention mechanism may be provided therein.

Further, the connector of the present invention makes it possible to reduce manufacturing costs and laborious work and time for removing residual repairing agent inside, because a path for the repairing agent formed inside the device is straight and does not include any complicated element, such as needle valve.

Although the invention has been described in detail and with reference to a specific embodiment thereof, it will be apparent to those skilled in the art that various changes and modifications may be made thereto without departing from the spirit and scope of the invention.

For example, an embodiment has been described in which voids and cracks are formed at a boundary between an inner concrete body and an outer mortar layer. However, the injection plug device of the present invention can be used also to inject concrete repairing agent into voids or cracks formed inside the inner concrete body or inside a sole concrete body without the outer mortar layer.

An embodiment has been described in which the sleeve of the plug device is located between the packing and stopper ring. However, such a sleeve can be omitted in such cases in which the packing is long enough or its location is changed.

Further, an embodiment has been described in which the flange like protrusion of the plug device is formed as one part of the tip side injection pipe to prevent the movement of the packing toward the tip portion. However, such a protrusion can be formed by dividing it into a plurality of parts separated from each other in circumferential direction or can be formed by engaging a ring like member on the outer surface of the tip portion of the tip side injection pipe.

Furthermore, an embodiment has been described in which grooves 12*a* are formed on the outer surface of the end side injection pipe 12 of the injection plug device to enhance frictional force in an effort to increase the strength of the mechanical connection and liquid seal between packing 22 of the connector 20 and injection plug device 10. However, such a groove can be omitted, in such a case in which injection pressure of the concrete repairing agent is fairly low, for example about 3 Kg/square cm.

Although the connector of the present invention has been described for connecting the injection plug device of the present invention to an injection hose, it can be also used for connecting injection plugs of the similar type to injection hoses.

Although, an example in which an injection hole is formed to have a tilt angle to the concrete wall is provided, it is understood that the injection plug device and the connector of the present invention can be used in such cases in which the injection holes are formed perpendicularly to the concrete wall.

What is claimed is:

1. An injection plug device for injecting concrete repairing agent into a concrete structure including:

a tip side injection pipe;

an end side injection pipe for housing an end portion of said tip side injection pipe at a tip portion thereof;

an attaching means including an elastic member attached to said tip side injection pipe to surround an outer surface thereof and a compression means for compressing said elastic member in a direction parallel to an axis thereof to cause an expansion of said elastic member in a radial direction to allow said elastic member to be attached to an inner wall of an injection hole; and back flow prevention means formed inside of said end side injection pipe for preventing back flow of the concrete repairing agent before solidification thereof;

wherein said back flow prevention means comprises a plane sheet of nearly square shape for making a narrow path for said concrete repairing agent between four sides thereof and an inner wall of said end side injection pipe, spring means for pushing said sheet upwards and means for pushing said sheet downwards by a tip thereon having a shape of a sharp knife edge.

2. A device for injecting an agent into a hole, said device comprising:

a first pipe having a tail end and a tip end;

a second pipe having a bottom portion and an upper portion, said bottom portion housing a portion of said tip end of said first pipe;

a back flow mechanism inside said second pipe for preventing back flow of said agent, said back flow mechanism including a sheet having a path for said agent, a downward pushing member and an upward pushing member for pushing said sheet downwardly and upwardly, respectively; and an elastic material surrounding an outer surface of a portion of said tail end of said first pipe;

wherein a portion of said device is inserted into said hole and said elastic material is compressed in a direction away from said tip end so as to allow a portion of said elastic material to rest upon an inner wall of said hole prior to injecting said agent into said hole.

3. The device of claim 2 further comprising an air purge plug for pressing down on said sheet.

4. A device for injecting an agent into a hole, said device comprising:

a first pipe having a tail end and a tip end;

a second pipe having a bottom portion and an upper portion, said bottom portion housing a portion of said tip end of said first pipe;

a back flow mechanism inside said second pipe for preventing back flow of said agent, said back flow mechanism including a sheet having a path for said agent, a downward pushing member and an upward pushing member for pushing said sheet downwardly and upwardly, respectively; and an elastic material surrounding an outer surface of a portion of said tail end of said first pipe;

wherein said agent exits said tail end of said first pipe to enter said hole, and wherein said tail end of said first pipe has a smaller diameter than said second pipe.

5. The device of claim 4 further comprising an air purge plug for pressing down said sheet.

* * * * *

UNITED STATES PATENT AND TRADEMARK OFFICE

CERTIFICATE OF CORRECTION

PATENT NO. : 5,948,444
DATED : September 7, 1999
INVENTOR(S) : Noboru Naito et al.

It is certified that error appears in the above-identified patent and that said Letters Patent is hereby corrected as shown below:

The Title page should be deleted and substitute therefore the attached title page.

Drawings,
Delete Fig. 7 and substitute therefore Fig. 7, as shown on the attached page.

Column 1,
Line 37, change "preferred non-" to -- preferred. Non- --

Signed and Sealed this

Twenty-fifth Day of March, 2003

JAMES E. ROGAN
*Director of the United States Patent and Trademark Office*

United States Patent [19]
Naito et al.

[11] Patent Number: 5,948,444
[45] Date of Patent: Sep. 7, 1999

[54] INJECTION PLUG DEVICE FOR INJECTING CONCRETE REPAIRING AGENT INTO A CONCRETE STRUCTURE

[75] Inventors: Noboru Naito; Toyoki Sato, both of Yamagata-ken, Japan

[73] Assignees: Hayashi Kensetsu Kogyo Kabushiki Kaisha; Nihon Mente Kaihatsu Kabushiki Kaisha, both of Yamagata-ken, Japan

[21] Appl. No.: 08/933,407

[22] Filed: Sep. 19, 1997

[30] Foreign Application Priority Data

Sep. 19, 1996 [JP] Japan ..... 8-269369

[51] Int. Cl.[6] ..... E04G 23/02

[52] U.S. Cl. ..... 425/13; 425/11; 425/563; 425/567; 425/12

[58] Field of Search ..... 425/11, 12, 13, 425/563, 567; 52/742.14; 264/36

[56] References Cited

U.S. PATENT DOCUMENTS

| | | | |
|---|---|---|---|
| 5,186,949 | 2/1993 | Lai | 425/11 |
| 5,223,272 | 6/1993 | Pringle | 425/12 |
| 5,329,740 | 7/1994 | Hayashi et al. | 52/514 |
| 5,809,736 | 9/1998 | Naito et al. | 52/742.14 |

FOREIGN PATENT DOCUMENTS 5-239932 9/1993 Japan .

*Primary Examiner*—Harold Pyon
*Assistant Examiner*—Mark A. Wentink
*Attorney, Agent, or Firm*—Lyon & Lyon LLP

[57] ABSTRACT

An injection plug device for injecting concrete repairing agent into a concrete structure and a connector to be connected to such an injection plug device are provided. The injection plug device has a small diameter, a simple structure, and low manufacturing cost to be appropriate to be used as a disposable device. The injection plug device (10) for injecting concrete repairing agent into a concrete structure includes a tip side injection pipe (11); an end side injection pipe (12) for housing an end portion of the tip side injection pipe (11) at the tip portion thereof, an attaching device (13) comprising an elastic member(13*a*) attached to the tip side injection pipe(11) to surround the outer surface thereof, and a compression device for compressing the elastic member(13*a*) in a direction parallel to an axis thereof to cause an expansion of the elastic member(13*a*) in its radial direction to make the elastic member attached to a inner wall of an injection hole; and a back flow preventing device (14) formed inside of the end side injection pipe for preventing back flow of injected concrete repairing agent before its solidification.

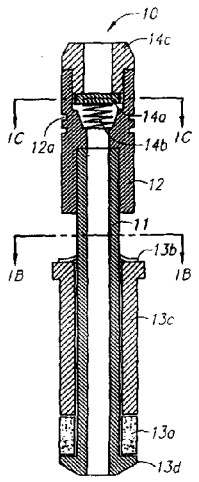

5 Claims, 5 Drawing Sheets